US006394328B1

(12) United States Patent
Zakarin

(10) Patent No.: US 6,394,328 B1
(45) Date of Patent: May 28, 2002

(54) REVERSIBLE BACKPACK

(75) Inventor: Lawrence J. Zakarin, Short Hills, NJ (US)

(73) Assignee: La Rue Distributors, Inc., New York, NY (US)

( * ) Notice: Subject to any disclaimer, the term of this patent is extended or adjusted under 35 U.S.C. 154(b) by 0 days.

(21) Appl. No.: 09/437,191

(22) Filed: Nov. 9, 1999

(51) Int. Cl.[7] ..... A45C 15/00

(52) U.S. Cl. ..... 224/579; 224/581; 224/604; 224/627; 224/643; 150/108

(58) Field of Search ..... 224/575, 578, 224/579, 581, 602, 604, 627, 643; 150/107, 108

(56) References Cited

U.S. PATENT DOCUMENTS

| | | | | | |
|---|---|---|---|---|---|
| 3,346,155 | A | * | 10/1967 | Oechsle | 150/108 X |
| D249,188 | S | | 8/1978 | Stewart | |
| D249,190 | S | | 8/1978 | Stewart | |
| 4,273,274 | A | | 6/1981 | Freistadt | |
| 4,545,414 | A | * | 10/1985 | Baum | 150/107 X |
| 4,810,102 | A | * | 3/1989 | Norton | 150/108 X |
| 4,856,570 | A | * | 8/1989 | Rushing et al. | 150/107 |
| 5,285,833 | A | * | 2/1994 | Haxby | 150/102 |
| 5,361,951 | A | | 11/1994 | Chehebar | |
| 5,415,332 | A | * | 5/1995 | Kliot | 224/153 |
| D359,847 | S | | 7/1995 | Callegari | |
| 5,431,317 | A | | 7/1995 | Kliot | |
| 5,797,529 | A | * | 8/1998 | Lavine | 224/575 |
| 5,927,581 | A | * | 7/1999 | Reddy et al. | 224/578 |
| 5,950,895 | A | | 9/1999 | Zakarin | |
| D432,298 | S | | 10/2000 | Markowitz | |
| 6,138,881 | A | * | 10/2000 | Paul et al. | 224/153 |

* cited by examiner

*Primary Examiner*—Stephen K. Cronin
(74) *Attorney, Agent, or Firm*—Mark P. Stone

(57) ABSTRACT

The present invention is directed to a backpack having a front surface, a rear surface, and at least one carrying strap to permit the backpack to be worn over the shoulders of a user. A connecting element on the backpack coupled to the carrying strap permits the user to selectively determine if the front or rear surface of the backpack is the surface which is exposed when the backpack is worn over the shoulders of the user.

7 Claims, 2 Drawing Sheets

REVERSIBLE BACKPACK

BACKGROUND OF THE INVENTION

The present invention is directed to backpacks of the type including a main storage compartment and a pair of carrying straps enabling the backpack to be worn over the shoulders of a user.

A traditional backpack includes a front surface which is exposed when the backpack is worn by a user, and a rear surface which faces the back of a user and is concealed when the backpack is worn over the shoulders of the user. Therefore, in a conventional backpack, only the front surface is exposed when the backpack is being worn.

The known prior art is exemplified by the following patents. U.S. Pat. No. 4,273,274 discloses a convertible handbag/backpack. U.S. Pat. No. 4,810,102 discloses a sport bag having adjustable straps for carrying the bag in three different positions. U.S. Pat. No. 5,361,951 discloses a backpack in which the interior surface thereof and the exterior surface thereof are interchangeable. U.S. Pat. No. 5,431,317 discloses a travelling bag which is convertible between a backpack, a shoulder bag and an over the head bag. U.S. Design Pat. Nos. 249,188, 249,190, and 359,847 disclose known designs for backpacks.

Additionally, the present Applicant owns U.S. Pat. No. 5,950,895 for a backpack including a storage compartment defined on the exposed front surface of the backpack when it is being worn by a user.

None of the aforementioned patents disclose a backpack having means for enabling the wearer of the backpack to selectively determine whether the front or rear surface of the backpack is the surface which is exposed when the backpack is worn by the user. In accordance with the primary objective of the present invention, a backpack includes means for permitting the user to selectively determine which of the front and rear surfaces of the backpack will be exposed when the backpack is worn by the user, and thus which of the front and rear surfaces of the backpack will be facing the back of the user and be concealed when the backpack is worn. In this manner, different designs and functional features (such as secondary storage compartments, bungi cords, and the like) on the front and rear surfaces of the backpack can be selectively exposed and concealed by the wearer. Other objects and advantages of the present invention will become apparent from the following description in conjunction with the drawings.

SUMMARY OF THE INVENTION

The present invention is directed to a backpack including a main storage compartment having at least one carrying strap connected thereto to be worn by the user. Preferably the backpack includes a pair of carrying straps extending therefrom to be worn over both shoulders of the user. The main storage compartment of the backpack is defined by a front surface and a rear surface which are joined together by opposed sidewalls and opposed top and bottom walls to form a closed compartment. Closure means, such as zippers and snaps, permit access into the main storage compartment. One end of each carrying strap is coupled proximate to the top of the backpack, while the other end of each carrying strap is connected by conventional coupling means proximate to the bottom of the backpack so that the straps and the backpack define spaces for receiving the arms and shoulders of the wearer. When the backpack is worn on the shoulders of the wearer, the front surface of the main storage compartment faces away from the wearer's back and is exposed, while the rear surface of the main storage compartment is adjacent to the back of the wearer and faces towards the back of the wearer and is concealed when the backpack is being worn.

In accordance with the present invention, connecting means are provided for the carrying straps of the backpack to enable the wearer to selectively reverse the orientation of the front and rear surfaces of the main storage compartment relative to the back of the wearer. In this manner, the front and rear surfaces can include different logos, designs, pictures, and functional elements (such as secondary storage compartments, bungi cords and the like), and the wearer can selectively determine which surface will be exposed and which surface will be concealed when the backpack is being worn. In the preferred embodiments of the invention, both the front and rear surfaces of the main storage compartment are padded for the comfort of the wearer.

In a first preferred embodiment of the invention, the means for reversing the orientation of the front and rear surfaces of the main storage compartment includes a connector element on the top wall of the main storage compartment having a strap bridging the front and rear surfaces of the backpack. A coupling element, as for example a loop, is mounted to the end of the carrying strap to be connected to the top of the backpack. The loop is received in the bridging element and is slideable along the bridging element between the front and rear surfaces of the backpack. In this manner, the orientation in which the carrying straps extend relative to the front and rear surfaces of the backpack can be selected by the wearer. This is accomplished by sliding the end of the carrying strap and the coupling element along the bridging element towards either the front or rear surface of the backpack, and pivoting the coupling element relative to the bridging element so that the carrying strap connected to the coupling element extends from the front or rear surface of the backpack as selected by the wearer. Suitable connecting means for the opposed end of the carrying strap are provided proximate to the bottom of the main storage compartment near both the front and rear surfaces of the main storage compartment so as to maintain the carrying strap in its selected orientation relative to the main storage compartment.

In a second preferred embodiment of the invention, a bridging element is formed from a connecting strap extending across the top wall of the main storage compartment of the backpack between the opposed sidewalls of the main storage compartment. A single connecting element is attached to the ends of a pair of carrying straps, and the connecting element is attached to the bridging element on the top wall of the storage compartment. The bridging element, which is preferably formed from an elastic material, can be flipped or rotated 180 degrees, at the selection of the user, resulting in rotation of the connecting element 180 degrees. In this manner, the direction of extension of the carrying straps relative to the front and rear surfaces of the main storage compartment is selectively reversible by flipping the connecting element and the bridging element relative to the top wall of the storage compartment so that the ends of the carrying straps attached to the connecting element extend in a direction either away from the front surface of the main storage compartment or away from the rear surface of the main storage compartment, at the selection of the user. The orientation of the carrying straps relative to the main storage compartment determines which of the front and rear surfaces thereof will be exposed when the backpack is being worn.

DESCRIPTION OF THE BEST MODES FOR CARRYING OUT THE INVENTION

Figure 1:
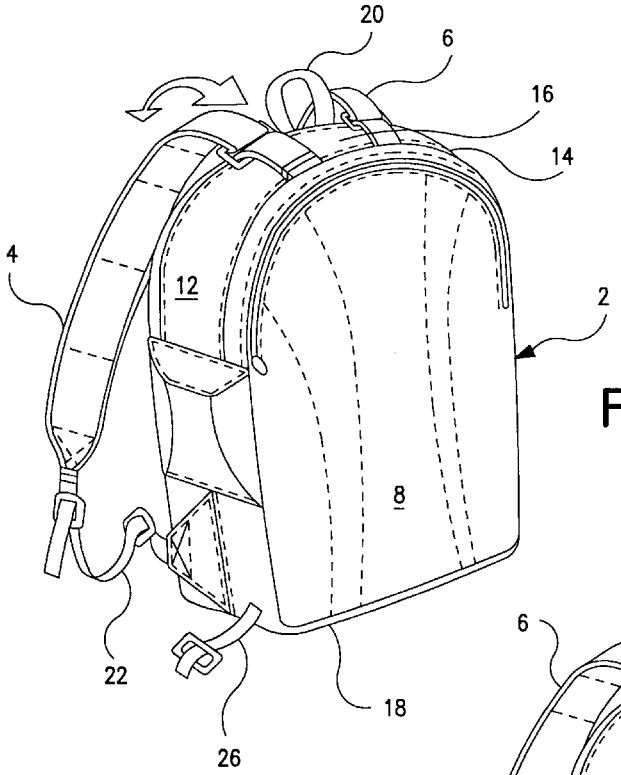
FIG. 1 illustrates a perspective view of a first embodiment of a backpack in accordance with the present invention in which the carrying straps are oriented in a first direction.
Figure 2:
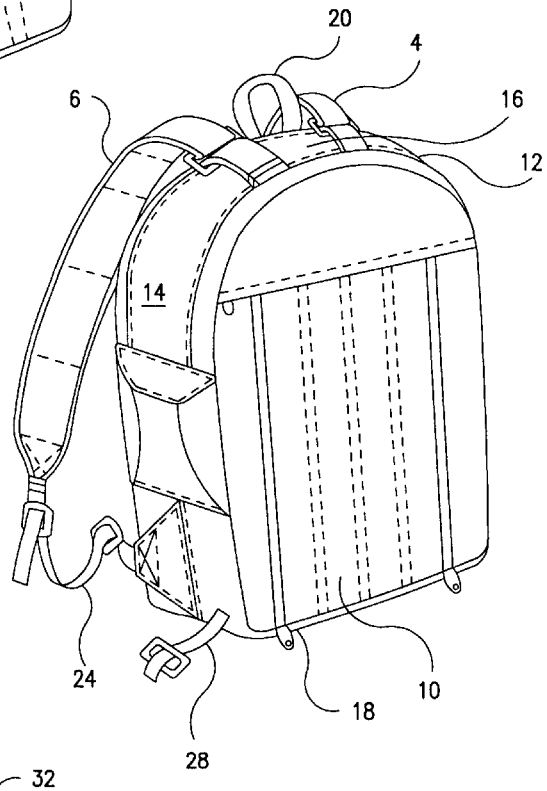
FIG. 2 illustrates the backpack of FIG. 1 in which the carrying straps are in the reverse orientation.
Figure 3:
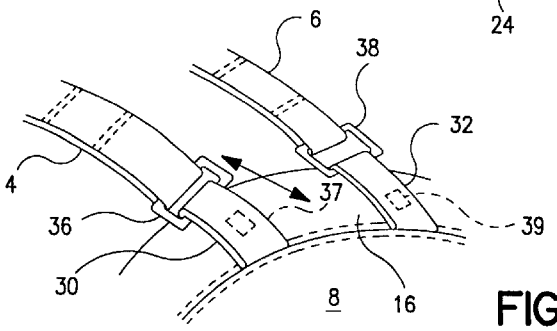
FIG. 3 illustrates connecting means on the backpack illustrated by FIGS. 1 and 2 for selectively reversing the orientation of the carrying straps relative to the backpack.

FIGS. 1–3 of the drawings illustrate a backpack in accordance with a first embodiment of the invention. The backpack includes a main storage compartment generally designated by reference numeral 2 and a pair of carrying straps, generally designated by reference numerals 4 and 6, connected to the top and bottom portions of the main storage compartment 2. As generally known to the art, the storage compartment includes closure means such as zippers or snaps which are provided to permit access into the storage compartment. The storage compartment also defines a front surface 8 (See FIG. 1) and an opposed rear surface 10 (See FIG. 2). The opposed front and rear surfaces 8 and 10 are connected by opposed sidewalls 12 and 14, a top wall 16, and a bottom wall 18. As can be seen from FIGS. 1 and 2, the front and rear surfaces 8 and 10, the opposed sidewalls 12 and 14, and the top and bottom walls 6 and 18 are connected together to form the closed volume which defines the main storage compartment 2.

As also illustrated by FIGS. 1 and 2, the top and bottom walls 16 and 18 and the opposed sidewalls 12 and 14 can be formed as a unitary, continuous, closed wall structure disposed between the front and rear surfaces 8 and 10. A loop 20 extends from the top of the storage compartment 2 to enable the backpack to be hung from a suitable supporting structure when the backpack is not being worn.

Still referring to FIG. 1 of the drawing, a strap 22 extends from the bottom rear portion of the storage compartment 2 and is coupled to the bottom end of carrying strap 4. The carrying strap 4 is removably connected to the strap 22 by conventional locking means to provide a closed loop for receiving the arm and shoulder of a wearer.

As shown in FIG. 1, a strap 22 is connected proximate to the rear surface 10 at the lower end of sidewall 12 of the main storage compartment 2. Similarly, a strap 26 is connected proximate to the front surface 8 at the lower end of sidewall 12 (FIG. 1); a strap 24 is connected proximate to the front surface 8 at the lower end of sidewall 14 (FIG. 2); and a strap 28 is connected proximate to the rear surface 10 at the lower end of sidewall 14 (FIG. 2).

When the backpack illustrated by FIG. 1 is worn by a user, the carrying straps 4 and 6 are oriented relative to the main storage compartment 2 such that the front surface 8 faces away from the wearer and will be exposed. The backpack illustrated by FIG. 2 reverses the orientation of the straps and storage compartment shown in FIG. 1 so that the rear surface 10, which was facing the back of the wearer and thus concealed in the orientation of the backpack illustrated by FIG. 1, now faces away from the wearer and is exposed. The selective reversal of the orientation of the carrying straps 4 and 6 relative to the main storage compartment 2 is accomplished by connecting means disclosed on the top wall 16 of the backpack illustrated by FIGS. 1 and 2. The connecting means is shown in detail by FIG. 3. The connecting means includes two bridging elements 30 and 32 which extend transversely across the top surface of the top wall 16 of the main storage compartment 2 between front and rear surfaces 8 and 10. The bridging elements can be formed from straps having front and rear ends which are sewn to the top wall 16 of the backpack. The top end of carrying strap 4 is connected to a coupling element or loop 36 which receives bridging element 30. Similarly, the top end of carrying strap 6 is connected to a coupling element or loop 38 which receives bridging element 32. The loops 36 and 38 are selectively movable between the opposed ends of bridging elements 30 and 32, respectively.

The position of the carrying straps 4 and 6 relative to the bridging elements 30 and 32, as shown in FIG. 3, corresponds to the orientation of the backpack illustrated by FIG. 1 in which the carrying straps are proximate to the rear surface 10. When the user desires to reverse this orientation, the bottom of the carrying straps 4 and 6 are uncoupled from the straps 22 and 28 at the bottom of the backpack, the carrying straps 4 and 6 are slid through the opposed ends of the bridging elements 30 and 32, the straps 4 and 6 and their respective coupling elements 36 and 38 are pivoted 180 degrees relative to the bridging elements 30 and 32 so that the carrying straps 4 and 6 extend in an opposite direction, and the lower ends of the carrying straps 4 and 6 are coupled to the lower straps 24 and 26 at the bottom of the backpack. In this manner, the relative orientation of the carrying straps and storage compartment of the backpack illustrated by FIG. 1 has been reversed into the orientation illustrated by FIG. 2 in which the carrying straps are proximate to the front surface 8. The orientation illustrated by FIG. 2 can be reversed back into that illustrated by FIG. 1 by reversing the procedure described above. In this manner, the user selectively determines whether the front surface 8 or the rear surface 10 of the main storage compartment of the backpack is the surface which will face outwardly and be exposed when the backpack is worn by the user.

FIG. 3 further illustrates releasable locking means 37 and 39 for releasably locking the center portions of bridging elements 30 and 32, respectively, to the top wall 16 of the main storage compartment. Each of the releasable locking means 37 and 39 includes two separate, mating locking components, as for example, complementary mating adhesive strips (marketed under the trademark VELCRO) or complementary snap connections. One of the locking components is attached to the approximate center of the lower surface of a bridging element, while the complementary locking component is attached to the upper surface of the top wall 16 of the main storage compartment in substantial alignment with the complementary locking component on the bridging element. In this manner, the complementary locking components of each of the releasable locking means 37, 39 face each other. When the locking means are in a closed position, the center of the bridging elements are attached to the top wall 16, thereby blocking movement of the coupling elements 36 and 38 across the center of the bridging elements. In this manner, the ends of the carrying straps 4 and 6 attached, respectively, to the coupling elements 36 and 38, are maintained closer to either the front surface 8 or the rear surface 10 of the main storage compartment, at the selection of the user. When the releasable locking means 37, 39 are in an opened position, the coupling elements 36 and 38 are movable between the ends of the bridging elements 30 and 32, respectively, at the selection of the user. Accordingly, the releasable locking means permit the user to selectively move the carrying straps towards either the front surface or the rear surface of the backpack, and thereafter restrict movement of the carrying straps to maintain them in the selected position.

Figure 4:
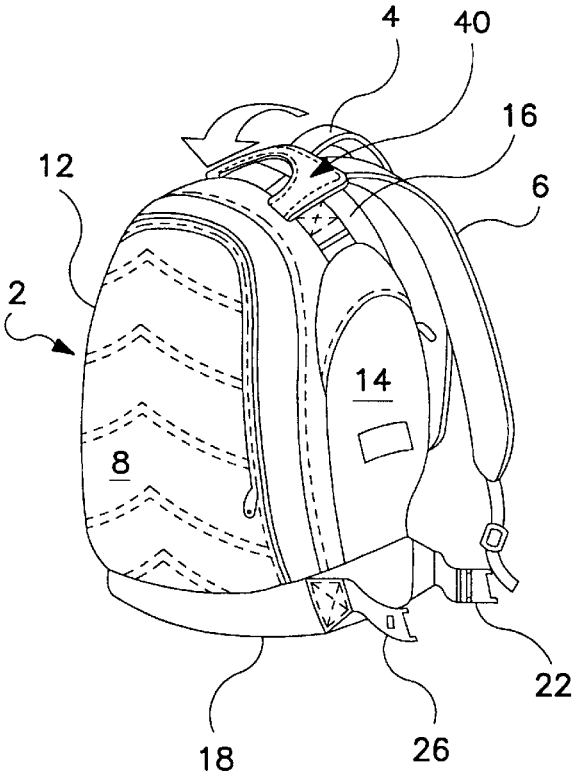
FIG. 4 illustrates a backpack in accordance with a second embodiment of a second invention in which the carrying straps are oriented in a first direction.
Figure 6:
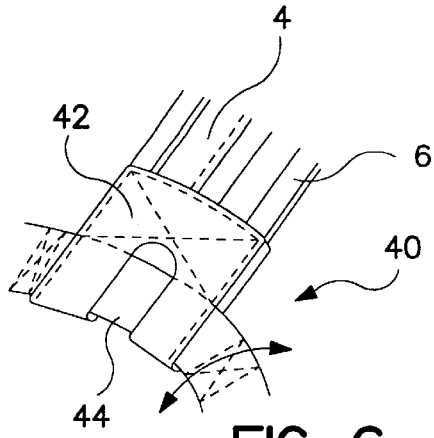
FIG. 6 illustrates connecting means on the backpack illustrated by FIGS. 4 and 5 for selectively reversing the orientation of the carrying straps relative to the backpack.
Figure 5:
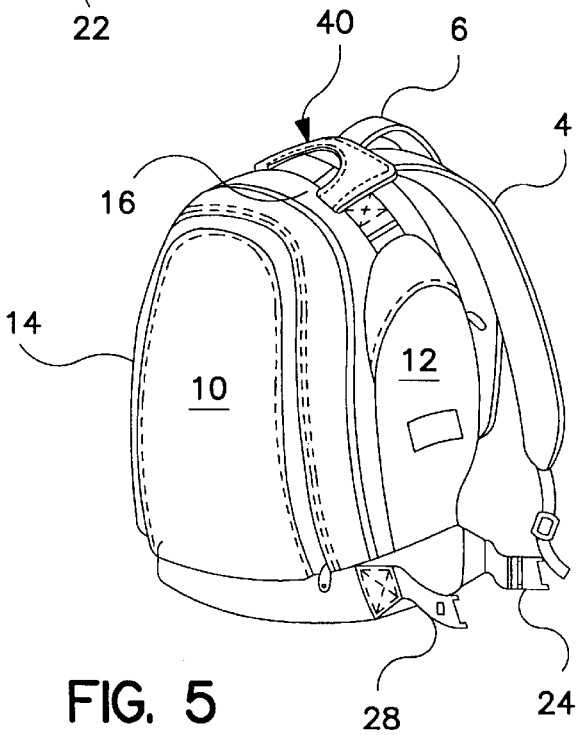
FIG. 5 illustrates the backpack of FIG. 4 in which the carrying straps are in the reverse orientation.

FIGS. 4–6 illustrate a second embodiment of a reversible backpack in accordance with the present invention. The same reference numerals used in FIGS. 1–3 of the drawings are used to designate common elements illustrated by FIGS. 4–6 of the drawings. The main storage compartment 2 of the backpack is formed from a front surface 8 and an opposed rear surface 10, which are connected by opposed sidewalls 12 and 14 and top and bottom walls 16 and 18. As discussed with respect to FIGS. 1–3, the opposed sidewalls 12 and 14 and the top and bottom wall 16 and 18 can be a unitary, continuous, integral, closed wall structure disposed between the front surface 8 and the rear surface 10.

In the orientation of the backpack illustrated by FIG. 4, the carrying straps 4 and 6 are arranged such that when the backpack is worn by a user, front surface 8 faces away from the user and is exposed. In the reverse orientation shown by FIG. 5, the rear surface 10 faces away from the wearer and is exposed when the backpack is worn. The bottom ends of the carrying straps 4 and 6 are connected to straps 22, 24, 26, and 28 in the same manner discussed with respect to FIGS. 1–3 to maintain the backpack in the orientation corresponding to either FIGS. 4 or 5, as selected by the wearer.

Strap connection means, generally designated by reference numeral 40, is disposed on the top wall 16 of the storage compartment 2, as illustrated by FIG. 4 and 5.

FIG. 6 illustrates the strap connection means 40 in detail. The strap connection means includes a connecting element designated by reference numeral 42. The upper ends of carrying straps 4 and 6 are fixedly connected to one end of the connecting element 42. The opposed end of the connecting element 42 includes an opening for receiving therein a bridging element 44 extending along the top wall 16 of the storage compartment 2 of the backpack between the opposed sidewalls 12 and 14. The bridging element can be sewn at its opposed ends to the top wall 16. The connecting element 42 is also attached to the bridging element 44. This attachment can be made by sewing a portion of the connecting element 42 to the bridging element 44. Accordingly, the upper ends of carrying straps 4 and 6 are attached to the connecting element 42, and the connecting element 42 is attached to the bridging element 44. Preferably, the bridging element 44 is a strap formed from an elastic or flexible material.

FIG. 6 illustrates the strap connection means 40 when the backpack is in the orientation illustrated by FIG. 4. To reverse this orientation, the lower ends of the carrying straps 4 and 6 are disconnected from the lower straps 22 and 28, the connecting element 42 coupled to the bridging element 44 is rotated or flipped 180 degrees relative to the top wall 16 of the backpack so that the carrying straps 4 and 6 extend in an opposite direction relative to the front surface 8, and the lower ends of the carrying straps 4 and 6 are connected to the lower straps 24 and 26 proximate to the front surface 8 of the backpack. In this manner, the orientation of the backpack has been reversed from that shown in FIG. 4 to that shown in FIG. 5, so that the rear surface 10 faces outwardly and is now exposed when the backpack is worn by the user. The orientation can again be reversed to that shown in FIG. 4 by reversing the procedure discussed above.

In both embodiments of the invention, the wearer selectively determines whether the front or rear surface of the backpack is the exposed surface when the backpack is worn. The front and rear surfaces can include different designs, logos, or functional features such as secondary storage compartments, bungi cords, and the like. Preferably, both the front and rear surfaces of the backpack are padded so that a padded surface is adjacent to the back of the use in either orientation of the backpack.

Other modifications and advantages of the backpacks described herein will be apparent to those skilled in the art. Accordingly, the descriptions of the preferred embodiments of the invention made herein are intended to be illustrative only, and not restrictive of the scope of the invention, that scope being defined by the following claims and all equivalents thereto.

What is claimed is:

1. A backpack comprising:

a main storage compartment having a first surface and a second surface;

at least one carrying strap having a first end thereof coupled to said main storage compartment at a first predetermined position for enabling said backpack to be worn by a wearer such that said first surface faces a first predetermined direction relative to said wearer and said second surface faces a second predetermined direction opposite to that faced by said first surface when said backpack is worn by said wearer; and means operatively associated with said at least one carrying strap for selectively reversing the direction at which said first and second surfaces of said backpack face relative to said wearer without uncoupling said first end of said carrying strap from said main storage compartment;

said first end of said at least one carrying strap being coupled to said means operatively associated with said at least one carrying strap;

said means operatively associated with said at least one said carrying strap comprising a connection element, said first end of said carrying strap being attached to said connection element;

said means operatively associated with said at least one carrying strap further comprising an anchoring element attached to said main storage compartment, said connection element being attached to said anchoring element;

said anchoring element being formed from an elastic material to permit said connection element and said first end of said carrying strap to be selectively rotated relative to said main storage compartment.

2. The backpack as claimed in claim 1 wherein said anchoring element comprises an elastic strap.

3. A backpack comprising:

a main storage compartment having a first surface and a second surface;

at least one carrying strap having a first end thereof coupled to said main storage compartment at a first predetermined position for enabling said backpack to be worn by a wearer such that said first surface faces a first predetermined direction relative to said wearer and said second surface faces a second predetermined direction opposite to that faced by said first surface when said backpack is worn by said wearer; and means on said main storage compartment for coupling said first end of said at least one carrying strap to said main storage compartment; said means comprising at least one bridging element on said main storage compartment disposed between said first and second surfaces of said main storage compartment, wherein said first end of said carrying strap includes means for selectively moving said carrying strap along said bridging element between said first and second surfaces of said main storage compartment without uncoupling said carrying strap from said bridging element.

4. The backpack as claimed in claim 3 wherein said means for moving includes a loop attached to said first end of said carrying strap, said bridging element being received in said loop.

5. The backpack as claimed in claim 3 further including cooperating locking means on said bridging element and on said main storage compartment for selectively restricting movement of said at least one carrying strap along said bridging element.

6. The backpack as claimed in claim 5 wherein said locking means includes a first locking component on said bridging element, and a second locking component on said main storage compartment in substantial alignment with said first locking component for selectively mating with said first locking component.

7. A backpack comprising:

a main storage compartment having a first surface and a second surface;

at least one carrying strap having a first end thereof coupled to said main storage compartment at a first predetermined position for enabling said backpack to be worn by a wearer such that said first surface faces a first predetermined direction relative to said wearer and said second surface faces a second predetermined direction opposite to that faced by said first surface when said backpack is worn by said wearer; and means on said main storage compartment for coupling said first end of said at least one carrying strap to said main storage compartment; said means comprising a connection element attached to said one end of said carrying strap, and an anchoring element attached to said main storage compartment;

said means on said main storage compartment being adapted to selectively reverse the direction at which said first and second surfaces face without uncoupling said first end of said carrying strap from said main storage compartment;

said anchoring element comprising an elastic band attached to said main storage compartment and received in an opening in said connection element; said carrying strap, said connection element and said anchoring element being selectively and conjointly rotatable relative to said main storage compartment.

* * * * *